US006527140B1

(12) United States Patent
Thompson et al.

(10) Patent No.: US 6,527,140 B1
(45) Date of Patent: Mar. 4, 2003

(54) TABLET DISPENSER

(75) Inventors: David Noble Thompson, North Shields (GB); Stephen William Bushby, Bedlington (GB); Ian Tennick, Cramlington (GB); Keith Stephenson, Newcastle upon Tyne (GB)

(73) Assignee: Audus Noble Limited, Blyth (GB)

( * ) Notice: Subject to any disclaimer, the term of this patent is extended or adjusted under 35 U.S.C. 154(b) by 0 days.

(21) Appl. No.: 09/959,524

(22) PCT Filed: Apr. 26, 2000

(86) PCT No.: PCT/GB00/01608

§ 371 (c)(1),
(2), (4) Date: Oct. 29, 2001

(87) PCT Pub. No.: WO00/66457

PCT Pub. Date: Nov. 9, 2000

(30) Foreign Application Priority Data

Apr. 30, 1999 (GB) ..... 9910145

(51) Int. Cl.[7] ..... B65G 59/00
(52) U.S. Cl. ..... 221/292; 206/535
(58) Field of Search ..... 221/289, 292, 221/198, 264; 206/535, 537, 459.1; 222/153.14, 553

(56) References Cited

U.S. PATENT DOCUMENTS 3,762,539 A * 10/1973 Kerr ..... 206/537
4,376,497 A * 3/1983 Mumford ..... 222/153.14

FOREIGN PATENT DOCUMENTS

GB 2258456 * 8/1992

* cited by examiner

*Primary Examiner*—Kenneth W. Noland
(74) *Attorney, Agent, or Firm*—Larson & Taylor PLC

(57) ABSTRACT

A tablet dispenser comprises an upwardly-open body portion (2), a plurality of flexible, circumferentially spaced tabs (4) around the upper end thereof to extend upwardly therefrom whereby gaps (6) are defined between adjacent tabs (4), an apertured lid portion (16) encasing the tabs (4) whereby the tabs (4) underlie the inner surface of the lid portion (16), cooperating locations means (10, 28) on the body portion (2) and the lid portion (16) so positioned that, on initial assembly of the dispenser, the lid portion (16) is located on the body portion (2) with the aperture (34) overlying a tab (4) to define a closed position of the dispenser, the lid portion (16) being rotatable relative to the body portion (2) to an open position in which the aperture (34) is aligned with a gap (6) between two adjacent tabs (4), and resilient means (14) reacting between the body portion (2) and the lid portion (16) such that it is first of all necessary to depress the lid portion (16) against the bias of the resilient means (14) to release the lid portion (16) into a position whereby it can be rotated to the open position.

6 Claims, 3 Drawing Sheets

TABLET DISPENSER

TECHNICAL FIELD

This invention relates to dispensers from which can be poured or shaken, in sequence, one or more tablets, for example artificial sweeteners, vitamin pills or the like.

BACKGROUND

Our UK patent No. 2258456 discloses a dispenser of this type which includes a moulded, upwardly open container integrally formed around the upper circumference of which are a plurality of flexible tabs defining gaps therebetween, and a lid which is a snap-fit on the container whereby the tabs are encased by the lid and underlie the inner surface of the lid.

The lid has an aperture therein, and is rotatable on the container between a closed position in which the aperture overlies a tab, and an open position in which the aperture is aligned with a gap between two adjacent tabs and a tablet can be dispensed therefrom.

Movement of the lid between the open and closed positions is effected by gripping the lid with the fingers and rotating the lid on the container. Such gripping can pose difficulties to the elderly or infirm who may have, for example, arthritis in their fingers. In such circumstances, it may be preferable for movement of the lid to be able to be achieved by the palm of a hand, for example by pressing and turning at the same time.

There is a need for tablet dispensers, particularly those for dispensing medicinal tablets such as aspirins, paracetamol or the like, to be child resistant whereby dispensing of a tablet is at least difficult for a child to achieve.

SUMMARY OF THE INVENTION

According to the present invention there is provided a tablet dispenser comprising a moulded, upwardly-open body portion of generally circular cross-section, a plurality of flexible, circumferentially spaced tabs integrally moulded with the body portion around the upper end thereof to extend upwardly therefrom whereby gaps are defined between adjacent tabs, a lid portion located on the upper end of the body portion to encase the tabs whereby the tabs underlie the inner surface of the lid portion, the lid portion having an aperture formed therethrough, and co-operating locations means on the body portion and the lid portion so positioned that, on initial assembly of the dispenser, the lid portion is located on the body portion with the aperture in the lid portion overlying a tab to define a closed position of the dispenser, the lid portion being rotatable relative to the body portion from said closed position to an open position in which the aperture in the lid portion is aligned with a gap between two adjacent tabs, characterised in that resilient means react between the body portion and the lid portion such that, to enable relative rotation of the lid portion on the body portion from the closed position to the open position, it is first of all necessary to depress the lid portion against the bias of the resilient means to release the lid portion into a position whereby it can be rotated to the open position, and further characterised in that the co-operating location means comprise, on one of the outer surface of the upper regions of the body portion and the inner surface of the lower regions of the lid portion, a plurality of circumferentially spaced first projections, one for each tab, each projection having a surface thereto extending at an acute angle to the longitudinal central axis of the body portion, and, on the other of the outer surface of the upper regions of the body portion and the inner surface of the lower regions of the lid portion, at least one second projection having a surface thereto at an angle corresponding to that of the surface on the first projections whereby, on initial assembly of the dispenser, the angled surfaces of the first and second projections abut one another and guide the lid portion to a closed position on the body portion, the first and second projections, in the closed position of the dispenser, being circumferentially aligned and abutting one another to prevent relative rotation between the lid portion and the body portion.

It will thus be appreciated that the necessity for downward movement of the lid portion prior to rotation thereof constitutes an effective child resistant feature to the dispenser, and also enables elderly or infirm persons to achieve opening of the dispenser without the need for finger gripping—opening can be achieved by pressing and turning with the palm of the hand which is likely to cause less difficulty to an arthritic user than finger gripping.

Preferably the resilient means comprise a plurality of circumferentially spaced spring legs integrally moulded with the upper regions of the body portion, the arrangement being such that, with the dispenser in its closed position, the spring legs react against a rim internally of the lid portion to align circumferentially the first and second projections to prevent relative rotation therebetween, depression of the lid portion against the bias of the spring legs displacing the projection or projections thereon below those on the body portion to permit relative rotation between the lid portion and the body portion.

In the open position of the dispenser, the projections on the lid portion and the body portion are longitudinally aligned, the resilient means, on release of the lid portion, urging aligned projections into engagement with one another, it being preferred that the abutting surfaces of the projections are configured to interlock with one another positively to define said open position of the dispenser.

In a preferred embodiment of the invention, the aperture in the lid portion is closed by a disc integrally moulded with the lid portion and attached thereto by a region of weakness, for example a circumferential strip of thinner material, which can be broken to release the disc from the aperture and open the aperture for dispensing purposes.

It will be appreciated that such an arrangement provides effective visual evidence of any tampering with the dispenser that may have occurred prior to authorised use thereof, in that, if the disc has been removed or otherwise displaced from its position within the aperture, the contents of the dispenser may already have been sampled.

DETAILED DESCRIPTION OF PREFERRED EMBODIMENT

Figure 1:
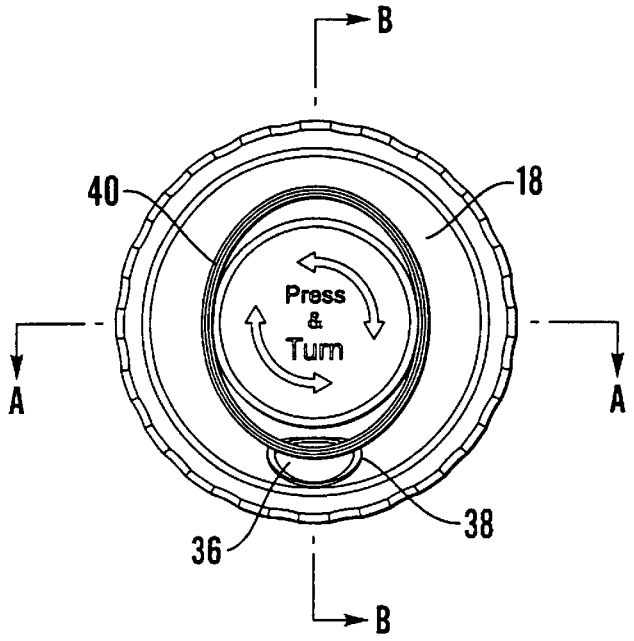
FIG. 1 is a plan view from above of a dispenser according to the invention.
Figure 2:
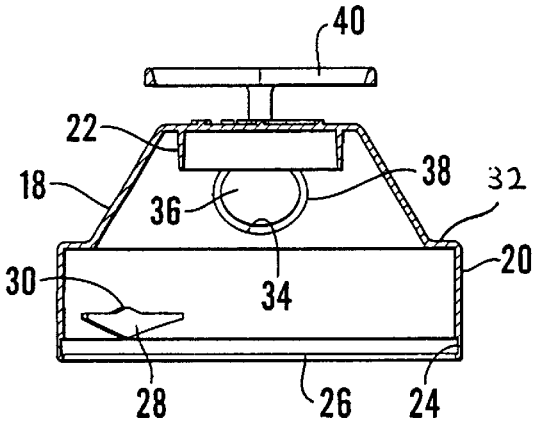
FIGS. 2 and 3 are sections on the lines A—A, B—B of FIG. 2 respectively of the lid portion of the dispenser of FIG. 1.
Figure 3:
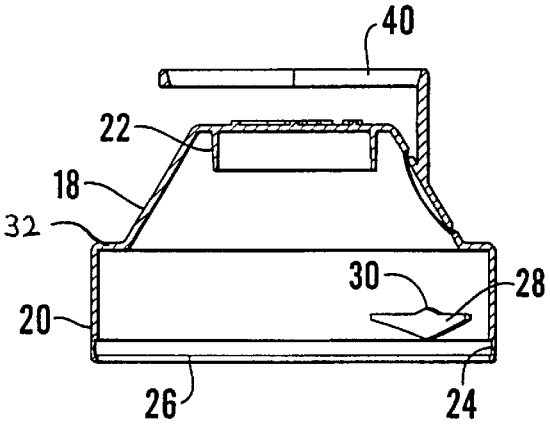
Figure 4:
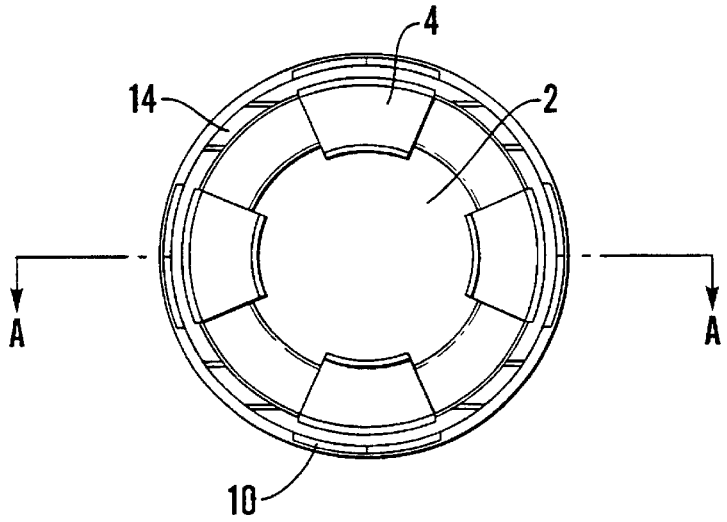
FIG. 4 is a plan view from above of the body portion of the dispenser of FIG. 1.

Referring to the drawings, the illustrated dispenser comprises a body portion or container 2 of moulded plastics material the circular cross-section of which increases slightly from bottom to top.

Figure 5:
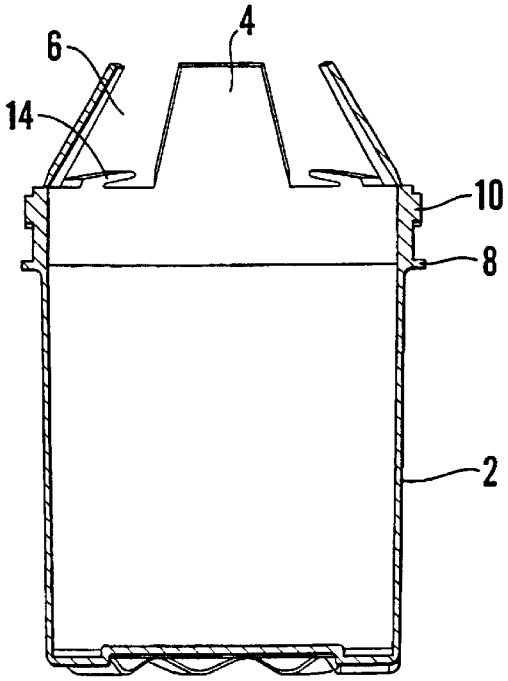
FIG. 5 is a section on the line A—A of FIG. 4.
Figure 6:
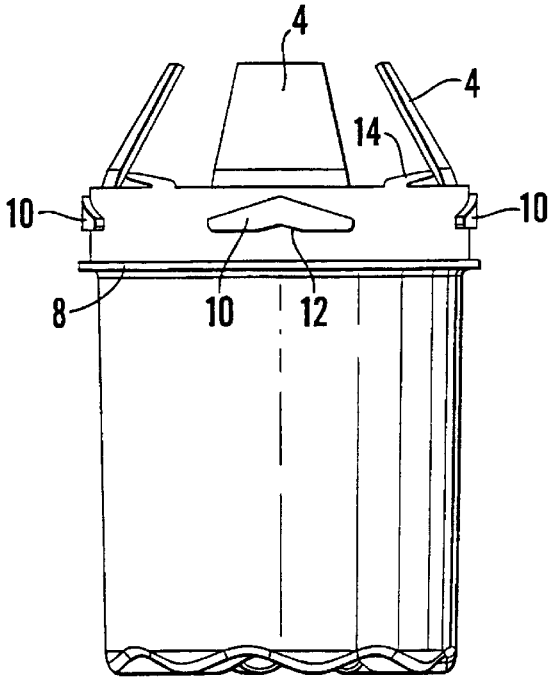
FIG. 6 is a front view of the body portion of FIG. 4.

Integrally moulded with the upper edge of the container 2 are a plurality of flexible, circumferentially spaced tabs 4 each having a normal rest position extending upwardly and inwardly of the body portion 2 as best seen in FIGS. 5 and 6. Conveniently there are four equi-spaced tabs 4 defining therebetween gaps 6 the width of which is greater than the maximum diameter of the tablets to be dispensed from the container 2.

A circumferential ridge 8 is integrally moulded around the upper regions of the container 2 for reasons which will become apparent, the ridge 8 having a substantially horizontal lower surface.

The container 2 further includes four circumferentially spaced projections 10 integrally moulded therewith around the upper regions thereof above the ridge 8, one immediately below each tab 4.

Each projection 10 is of generally triangular configuration and includes a pair of downwardly angled upper surfaces and a transverse lower surface having a central indent 12 therein for reasons which will become apparent.

Also integrally moulded with the upper edge of the container 2 are a plurality, conveniently four, of circumferentially spaced spring legs 14, each leg extending upwardly at an angle from the container 2 as best seen in FIGS. 5 and 6, and being positioned radially outwardly of the bottom ends of the tabs 4 and between the tabs.

The dispenser is completed by a moulded lid portion indicated generally at 16 and including a generally truncated conical top wall 18 from which depends a cylindrical side wall 20.

A circular boss 22 extends downwardly from the central underside of the top wall 18, while the side wall 20 terminates in a reduced thickness extent 24 having an inwardly projecting flange 26 around the free end thereof.

Integrally moulded on the inner surface of the side wall 20 immediately above the extent 24 are four circumferentially spaced projections 28 each of generally inverted triangular configuration. Each projection 28 includes a pair of upwardly angled lower surfaces and a transverse upper surface having a central peak 30 thereon, again for reasons which will become apparent.

The lid portion 16 includes, between the top wall 18 and the side wall 20 a stepped rim 32.

An aperture 34 is formed in the top wall 18 of the lid portion 16 of such a size that a single tablet of the tablet content of the container 2 can pass therethrough.

On initial moulding of the lid portion 16, the aperture 34 contains a disc 36 of material connected to the lid portion 16 by a circumferential strip 38 of thinner material defining a line of weakness between the lid portion 16 and the disc 36. Integrally moulded with, to project upwardly from, the disc 36 is a ring-pull 40, pulling on the ring-pull 40 serving to break the strip 38 of thinner material, whereby the disc 36 is released from the lid. This arrangement provides an effective tamper evident device, in that any unauthorised removal of the disc 36 is indicative of tampering with the content of the dispenser possibly having occurred.

Prior to assembly of the dispenser, the container 2 is filled with the relevant tablets, the flexible nature of the tabs 4 enabling ready access to the interior of the container 2.

The lid portion 16 is then located above the container 2 and is pushed down onto the container 2. In so doing the tabs 4 are received within the side wall 20 and engage the underside of the top wall 18.

Continued depression of the lid portion 16 causes the tabs 4 to flex inwardly to underlie the angled region of the top wall 18, the flange 26 eventually snapping under the ridge 8 to retain the lid portion 16 on the container 2. In this assembled condition of the dispenser, and as seen in FIG. 7, the tabs 4 lie closely adjacent the top wall 18 of the lid portion 16 with their free ends spaced from the underside of the top wall of the lid portion 16.

On assembly, it is desired that the aperture 34 in the lid portion 16 overlies one of the tabs 4 so that the dispenser is initially closed. This is ensured by the projections 10, 28 which are so positioned that, if the aperture is not circumferentially aligned with a tab 4, the tapering surfaces of the projections on the lid portion 16 and the container 2 abut one another, continued downward movement of the lid portion 16 relative to the container 2 resulting in rotation of the lid portion 16 on the container 2 such that, on complete assembly, the aperture overlies a tab 4, the projections 10, 28 then being circumferentially aligned to prevent further rotation of the lid portion 16 on the container 2.

During assembly of the dispenser, the free ends of the spring legs 14 are brought into initial engagement with the rim 32 in the lid portion 16.

Figure 7:
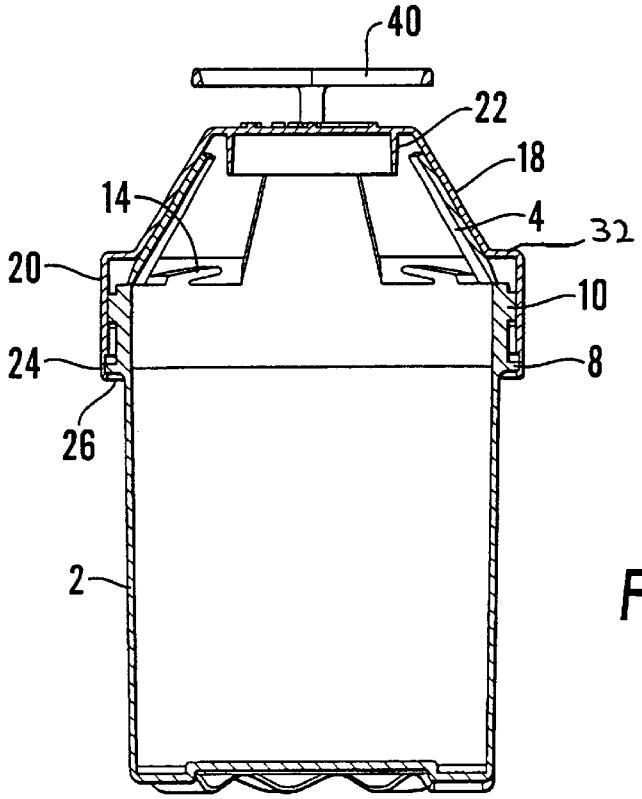
FIG. 7 is a section on the line A—A of the dispenser of FIG. 1.
Figure 8:
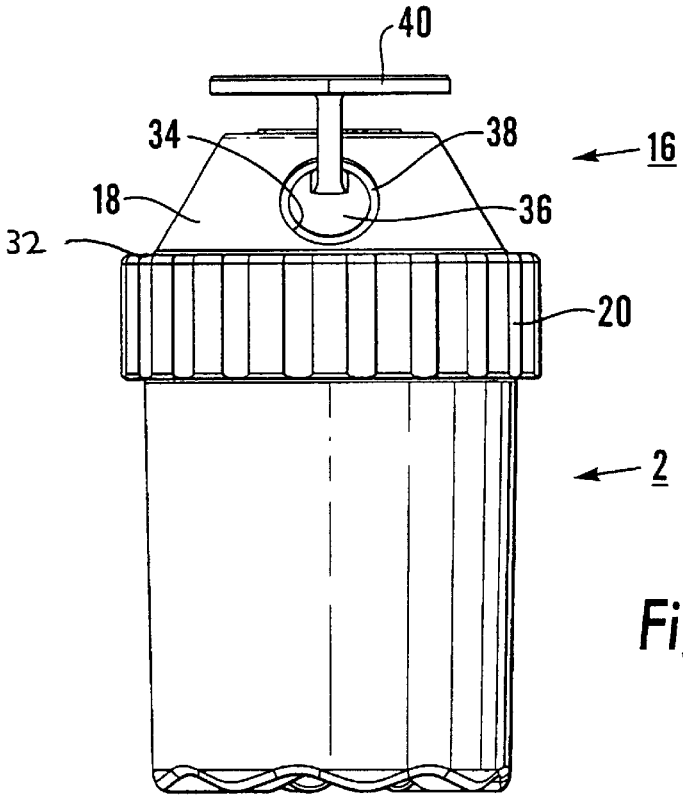
FIG. 8 is a front view of the dispenser of FIG. 1.

In this assembled, closed condition of the dispenser shown in FIG. 7, the flange 26 on the lid portion 16 engages the undersurface of the ridge 8 on the container 2, the projections 10, 28 are circumferentially aligned, the spring legs 34 on the container 2 are relatively unstressed, and the tops of the tabs 4 on the container 2 are spaced downwardly from the top wall of the lid portion 16.

Opening of the dispenser is achieved by first of all depressing the lid portion 16 downwardly against the bias of the spring legs 14 to move the projections 28 on the lid portion 16 below the level of the projections 10 on the container 2. This downward movement of the lid portion 16 is accommodated by the container 2, in that there is space within the extent 24 of the side wall 20 of the lid portion 16 to retain therein the ridge 8, while there is space above the tabs 4 to allow the downward movement of the lid portion 16.

After said depression, the lid portion 16 can be rotated to move the aperture 34 into alignment with a gap 6 between two adjacent tabs 4 whereby one tablet at a time can be poured or shaken from the container 2 on inversion of the dispenser.

In this open position of the dispenser, the projections 10, 28 are longitudinally aligned, with the projections 28 each below an associated projection 10. The spring legs 14 constantly bias the lid portion 16 upwards relative to the container 2 whereby the peaks 30 on the projections 28 are urged into engagement with the indents 12 in the associated projections 10, thereby positively to determine said open position of the dispenser.

Subsequent closure of the dispenser is achieved by further rotation of the lid portion 16 in either direction to disengage thee projections 10, 28, the spring legs 14 then returning the lid portion 16 to its uppermost closed position in which the aperture 34 again overlies a tab 4.

The operation of push down and turn is required each time a tablet is to be dispensed from the container 2 thereby preventing accidental overdosing of tablets, the size of the aperture 34 being chosen to make it difficult to dispense more than one tablet at a time.

Thus there is provided a lightweight dispenser of relatively simple construction that is relatively cheap to manufacture and assemble and which incorporates an in-built child resistant feature which also serves to facilitate operation without the necessity for finger gripping.

Clearly the precise construction of the dispenser can vary from that described and illustrated. In particular the number and locations of the tabs 4 and gaps 6 can be altered to suit particular requirements, as can the number and locations of the projections 10, 28 providing there are as many projections on one of the lid portion 16 or container 2 as there are tabs 4, and there is at least one projection on the other of the lid portion 16 or container 2. It is however preferred that there are equal numbers of projections 10, 28 and tabs 4.

The resilient means may be other than spring legs 14, for example a circumferentially undulating spring member, while the dispenser may or may not incorporate the tamper evident feature detailed above.

What is claimed is:

1. A tablet dispenser comprising a moulded, upwardly-open body portion of generally circular cross-section, a plurality of flexible, circumferentially spaced tabs integrally moulded with the body portion around the upper end thereof to extend upwardly therefrom whereby gaps are defined between adjacent tabs, a lid portion located on the upper end of the body portion to encase the tabs whereby the tabs underlie the inner surface of the lid portion, the lid portion having an aperture formed therethrough, and co-operating locations means on the body portion and the lid portion so positioned that, on initial assembly of the dispenser, the lid portion is located on the body portion with the aperture in the lid portion overlying a tab to define a closed position of the dispenser, the lid portion being rotatable relative to the body portion from said closed position to an open position in which the aperture in the lid portion is aligned with a gap between two adjacent tabs, characterized in that resilient means react between the body portion and the lid portion such that, to enable relative rotation of the lid portion on the body portion from the closed position to the open position, it is first of all necessary to depress the lid portion against the bias of the resilient means to release the lid portion into a position whereby it can be rotated to the open position, and further characterized in that the co-operating location means comprise, on one of the outer surface of the upper regions of the body portion and the inner surf ace of the lower regions of the lid portion, a plurality of circumferentially spaced first projections, one for each tab each projection having a surface thereto extending at an acute angle to the longitudinal central axis of the body portion, and, on the other of the outer surface of the upper regions of the body portion and the inner surface of the lower regions of the lid portion, at least one second projection having a surface thereto at an angle corresponding to that of the surface on the first projections whereby, on initial assembly of the dispenser, the angled surfaces of the first and second projections abut one another and guide the lid portion to a closed position on the body portion, the first and second projections, in the closed position of the dispenser, being circumferentially aligned and abutting one another to prevent relative rotation between the lid portion and the body portion.

2. A tablet dispenser as claimed in claim 1 in which the resilient means comprise a plurality of circumferentially spaced spring legs integrally moulded with the upper regions of the body portion, the arrangement being such that, with the dispenser in its closed position, the spring legs react against a rim internally of the lid portion to align circumferentially the first and second projections to prevent relative rotation therebetween, depression of the lid portion against the bias of the spring legs displacing the projection or projections thereon below those on the body portion to permit relative rotation between the lid portion and the body portion.

3. A tablet dispenser as claimed in claim 1 in which, in the open position of the dispenser, the projections on the lid portion and the body portion are longitudinally aligned, the resilient means, on release of the lid portion, urging aligned projections into engagement with one another.

4. A tablet dispenser as claimed in claim 3 in which the abutting surfaces of the projections are configured to interlock with one another positively to define said open position of the dispenser.

5. A tablet dispenser as claimed in claim 1 in which the aperture in the lid portion is closed by a disc integrally moulded with the lid portion and attached thereto by a region of weakness, which can be broken to release the disc from the aperture and to open the aperture for dispensing purposes.

6. A tablet dispenser as claimed in claim 5 in which the region of weakness comprises a circumferential strip of material thinner than that of the lid portion.

* * * * *